US005688758A

United States Patent [19]

Reinehr et al.

[11] Patent Number: 5,688,758

[45] Date of Patent: Nov. 18, 1997

[54] TEXTILE TREATMENT

[75] Inventors: Dieter Reinehr, Kandern, Germany; Claude Eckhardt, Riedisheim, France

[73] Assignee: Ciba Specialty Chemicals Corporation, Tarrytown, N.Y.

[21] Appl. No.: 662,091

[22] Filed: Jun. 12, 1996

Related U.S. Application Data

[63] Continuation of Ser. No. 471,043, Jun. 6, 1995, abandoned.

[30] Foreign Application Priority Data

Jul. 1, 1994 [GB] United Kingdom ..... 94 13270

[51] Int. Cl.[6] ..... D06M 13/00; D06M 13/248; D06M 13/322; D06M 13/46

[52] U.S. Cl. ..... 510/516; 252/8.61; 252/8.91; 510/517; 510/518; 510/521; 510/522

[58] Field of Search ..... 510/516, 517, 510/518, 521, 522; 252/8.91, 8.61

[56] References Cited

U.S. PATENT DOCUMENTS

| | | | |
|---|---|---|---|
| 4,009,193 | 2/1977 | Scheuermann et al. | 260/459 A |
| 4,339,393 | 7/1982 | Lüthi et al. | 260/459 |
| 4,384,121 | 5/1983 | Meyer | 548/217 |
| 4,433,975 | 2/1984 | Meyer | 8/648 |
| 4,468,352 | 8/1984 | Lüthi et al. | 260/459 |
| 4,478,598 | 10/1984 | Meyer et al. | 8/648 |
| 4,539,161 | 9/1985 | Guglielmetti | 260/465 |
| 4,562,002 | 12/1985 | Neiditch et al. | 252/8.75 |
| 4,602,087 | 7/1986 | Lüthi et al. | 544/78 |
| 4,772,404 | 9/1988 | Fox et al. | 252/8.8 |
| 5,082,578 | 1/1992 | Langer et al. | 252/8.7 |
| 5,164,100 | 11/1992 | Langer et al. | 252/8.6 |

FOREIGN PATENT DOCUMENTS

| | | |
|---|---|---|
| 0029003 | 5/1981 | European Pat. Off. . |
| 0074590 | 3/1983 | European Pat. Off. . |
| 0132138 | 1/1985 | European Pat. Off. . |
| 0192600 | 8/1986 | European Pat. Off. . |
| 0275694 | 7/1988 | European Pat. Off. . |
| 2023605 | 1/1980 | United Kingdom . |
| 9404515 | 3/1994 | WIPO . |

*Primary Examiner*—Anthony Green
*Attorney, Agent, or Firm*—Kevin T. Mansfield

[57] ABSTRACT

There is provided a stable, concentrated fabric rinse composition comprising 0.3 to 10, preferably 0.3 to 3% by weight of a fluorescent whitening agent which is compatible with a fabric care ingredient, preferably a cationic, amphoteric or anionic fluorescent whitening agent, based on the total weight of the composition, and optionally a fabric care ingredient, preferably a fabric softener, a stain release or stain repellant ingredient or a water-proofing agent, the remainder being substantially water. The fabric rinse composition is preferably a fabric softener composition comprising 5 to 25, preferably 10 to 20% by weight of a cationic fabric softening agent and 0.3 to 10, preferably 0.3 to 3% by weight of a cationic, amphoteric or anionic fluorescent whitening agent, each based on the total weight of the composition, the remainder being substantially water. The present invention also provides method for the treatment of a textile article, comprising applying, to the previously washed article, the said fabric rinse composition, preferably the rinse cycle fabric softener composition, whereby the sun protection factor, and other properties such as the tear Strength and lighffastness of articles so treated can be significantly increased.

27 Claims, No Drawings

TEXTILE TREATMENT

This application is a continuation of application Ser. No. 08/471,043, filed Jun. 6, 1995, now abandoned.

The present invention relates to a composition for the treatment of textiles, in particular to a composition containing a fluorescent whitenhag agent and to a method of treating textiles with the composition for the improvement of the sun protection factor (SPF) of textile fibre material treated with the composition.

It is known that light radiation of wavelengths 280–400 nm permits tanning of the epidermis. Also known is that rays of wavelengths 280–320 nm (termed UV-B radiation), cause erythemas and skin burning which can inhibit skin tanning. Radiation of wavelengths 320–400 nm (termed UV-A radiation) is known to induce skin tanning but can also cause skin damage, especially to sensitive skin which is exposed to sunlight for long periods. Examples of such damage include loss of skin elasticity and the appearance of wrinkles, promotion of the onset of crythereat reaction and the inducement of phototoxic or photoallergic reactions.

Any effective protection of the skin from the damaging effects of undue exposure to sunlight clearly needs to include means for absorbing both UV-A and UV-B components of sunlight before they reach the skin surface.

Traditionally, protection of exposed human skin against potential damage by the UV components in sunlight has been effected by directly applying to the skin a preparation containing a UV absorber. In areas of the world, e.g. Australia and America, which enjoy especially sunny climates, there has been a great increase in the awareness of the potential hazards of undue exposure to sunlight, compounded by fears of the consequences of alleged damage to the ozone layer. Some of the more distressing embodiments of skin damage caused by excessive, unprotected exposure to sunlight are development of melanomas or carcinomas on the skin.

One aspect of the desire to increase the level of skin protection against Shnlight has been the consideration of additional measures, over and above the direct protection of the skin. For example, consideration has been given to the provision of protection to skin covered by clothing and thus not directly exposed to sunlight.

Most natural and synthetic textile materials are at least partially permeable to UV components of sunlight. Accordingly, the mere wearing of clothing does not necessarily provide skin beneath the clothing with adequate protection against damage by UV radiation. Although clothing containing a deeply coloured dye and/or having a tight weave texture may provide a reasonable level of protection to skin beneath it, such clothing is not practical in hot sunny climates, from the standpoint of the personal comfort of the wearer.

There is a need, therefore, to provide protection against UV radiation for skin which lies tmdemeath clothing, including lightweight snmmer clothing, which is undyed or dyed only in pale shades. Depending on the nature of the dyestuff, skin covered by clothing dyed in some dark shades may also require protection against UV radiation.

Such lightweight summer clothing normally has a density of of less than 200 g/m$^2$ and has a sun protection factor rating between 1.5 and 20, depending on the type of fibre from which the clothing is manufactured.

The SPF rating of a sun protectant (sun cream or clothing) may be defined as the mnltiple of the time taken for the average person wearing the sun protectant to suffer sun burning under average exposure to sun. For example, ff an average person would normally suffer sun burn after 30 minutes under standard exposure conditions, a sun protectant having an SPF rating of 5 would extend the period of protection from 30 minutes to 2 hours and 30 minutes. For people living in especially sunny climates, where mean sun burn times are minimal, e.g. only 15 minutes for an average fair-skinned person at the hottest time of the day, SPF ratings of at least 20 are desired for lightweight clothing.

Surprisingly, it has now been found that the application, to a washed article of clothing, of a rinse cycle fabric care formnlation comprising a fluorescent whitening agent which is compatible with a fabric care ingredient, preferably a cationic, amphoteric or artionic fluorescent whitening agent, especially a rinse cycle fabric softener comprising a fluorescent whitening agent which is compatible with a fabric softener ingredient, preferably a cationic, amphoteric or anionic fluorescent whiterting agent, containing a higher amount of fluorescent whitening agent than is used in conventional rinse cycle fabric care formulations, imparts an excellent whiteness and sun protection factor to the fibre material so treated.

The present invention provides, therefore, as a first aspect, a stable, concentrated fabric rinse composition comprising 0.3 to 10, preferably 0.3 to 3% by weight of a fluorescent whitening agent which is compatible with a fabric care ingredient, preferably a cationic, amphoteric or artionic fluorescent whitenLug agent, based on the total weight of the composition, and optionally a fabric care ingredient, preferably a fabric softener, a stain release or stain repellant ingredient or a water-proofing agent, the remainder being substantially water.

The fabric care ingredient is preferably present in an mount of from 2 to 25, preferably 5 to 20% by weight, based on the total weight of the composition.

The present invention provides, as a second aspect, a stable, concentrated rinse cycle fabric softener composition comprising 2 to 25, preferably 5 to 20% by weight of a fabric care ingredient, preferably a cationic fabric softening agent and 0.3 to 10, preferably 0.3 to 3% by weight of a fluorescent whitening agent which is compatible with a fabric care ingredient, preferably a cationic, amphoteric or artionic fluorescent whitening agent, each based on the total weight of the composition, the remainder being substantially water.

Preferred examples of cationic fabric softening agents include imidazolines, quaternary ammonium compounds, ester amide amine salts, as well as mixtures thereof.

Preferred imidazoline cationic fabric softening agents are those having the formula:

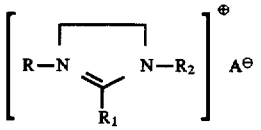

(1)

in which R is hydrogen or $C_1$–$C_4$alkyl; $R_1$ is a $C_8$–$C_{30}$aliphatic residue; $R_2$ is —$C_2H_4$—O(C=O)—$R_1$ or —$C_2H_4$—NH(C=O)—$R_1$; and A is an ation.

Preferably R is hydrogen or methyl; $R_1$ is $C_{14}$–$C_{18}$alkyl or $C_{14}C_{18}$alkenyl; and $R_2$ is —$C_2H_4$—O(C=O)—$C_{14}C_{18}$alkyl or —$C_{14}$–$C_{18}$alkenyl, or —$C_2H_4$—NH(C=O)—$C_{14}$–$C_{18}$alkyl or —$C_{14}$–$C_{18}$alkenyl.

Other preferred imidazoline cationic fabric softening agents are those having the formula:

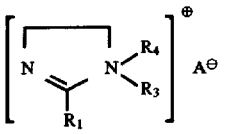

(2)

in which $R_1$ and A have their previous significance; $R_3$ and $R_4$, independently, are a $C_8$–$C_{30}$aliphatic residue, $C_1$–$C_4$alkyl, $C_1$–$C_4$halogenoalkyl, $C_1$–$C_4$hydroxyallcyl or a group —$C_2H_4$—N($R_5$)—C(=O)—$R_6$ in which $R_5$ is hydrogen or $C_8$–$C_{30}$alkyl and $R_6$ is hydrogen or $C_1$–$C_4$alkyl.

Preferably $R_1$ is $C_{14}$–$C_{18}$alkyl or $C_{14}$–$C_{18}$alkenyl; $R_3$ is $C_{14}$–$C_{18}$alkyl, $C_{14}$–$C_{18}$alkenyl, $C_1$–$C_4$alkyl, $C_1$–$C_4$halogenoalkyl or $C_1$–$C_4$hydroxyalkyl; and $R_4$ is a group —$C_2H_4$—N($R_5$)—C(=O)—$R_6$ in which $R_5$ is hydrogen or $C_8$–$C_{30}$alkyl and $R_6$ is hydrogen or $C_1$–$C_4$alkyl.

Preferred anions A include chloride, bromide, iodide, fluoride, sulfate, methosulfate, nitrite, nitrate or phosphate anions, as well as carboxylate artions such as acetate, adipate, phthalate, benzoate, stearate or oleate anions.

Specific examples of preferred compounds of formula (1) include:

2-tallow-1-(2-stearoyloxyethyl)-imidazoline chloride, 2-tallow-1-(2-stearoyloxyethyl)-imidazoline sulfate, 2-tallow-1-(2-stearoyloxyethyl)-imidazoline methosulfate, 2-tallow-1-methyl-3-(2-stearoylamidoethyl)-imidazoline chloride, 2-tallow-1-methyl-3-(2-stearoylamidoethyl)-imidazoline sulfate and 2-tallow-1-methyl-3-(2-stearoylamidoethyl)-imidazoline methosulfate.

Specific examples of preferred compounds of formula (2) include:

2-heptadecyl-1-methyl-1-oleylamidoethyl-imidazolininm-metho-sulfate, 2-heptadecyl-1-methyl-1-(2-stearoylamido)ethyl-imidazolinium-sulfate, 2-heptadecyl-1-methyl-1-(2-stearoylamido)ethyl-imidazolinium-chloride 2-coco-1-(2-hydroxyethyl)-1-benzyl-imidazolinium-chloride 2-coco-1-(2-hydroxyethyl)-1-(4-chlorobutyl)-imidazolinium-chloride 2-coco-1-(2-hydroxyethyl)-1-octadecenyl-imidazolinium-chloride 2-tallow-1-(2-hydroxyethyl)-1-benzyl-imidazolinium-chloride 2-tallow-1-(2-hydroxyethyl)-1-(4-chlorobutyl)-imidazolinium-chloride 2-heptadecenyl-1-(2-hydroxyethyl)-1-(4-chlorobutyl)-imidazolinium-chloride 2-heptadecenyl-1-(2-hydroxyethyl)-1-benzyl-imidazolinium-chloride and 2-heptadecenyl-1-(2-hydroxyethyl)-1-octadecyl-imidazolinium-chloride One class of preferred quaternary ammoninm compounds is that having the formula:

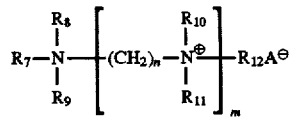

(3)

in which $R_7$ is a $C_8$–$C_{30}$aliphatic residue, $R_8$, $R_9$, $R_{10}$, $R_{11}$ and $R_{12}$, independently, are hydrogen, $C_1$–$C_4$alkyl or $C_1$–$C_4$hydroxyalkyl, A has its previous significance, m is an integer from 1 to 5 and n is an integer from 2 to 6.

Preferred compounds of formula (3) are those in which $R_7$ is $C_{12}$–$C_{18}$alkyl and $R_8$, $R_9$, $R_{10}$, $R_{11}$ and $R_{12}$, independently, are $C_1$–$C_4$alkyl, especially methyl.

Specific examples of preferred compounds of formula (3) are:

N-(tallow)-N,N,N',N'-tetramethyl-1,3-propanediammoniumdimethosulfate

N-(tallow)-N,N',N'-trimethyl-1,3-propanediammoniumdimethosulfate

N-(tallow)-N,N,N',N',N'-pentamethyl-1,3-propanediammoniumdimethosulfate

N-oleyl-N,N,N',N',N'-pentamethyl-1,3-propanediammoniumdimethosulfate

N-stearyl-N,N,N',N',N'-pentamethyl-1,3-propanediammoniumdimethosulfate and

N-stearyloxypropyl-N,N',N'-tris(3-hydroxypropyl)-1,3-propanediammoniumdiacetate.

A further class of preferred quaternary ammonium compounds is that having the formula:

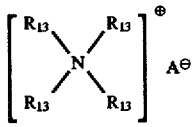

(4)

in which A has its previous significance and the groups $R_3$ may be the same or different and each is a $C_1$–$C_{30}$aliphatic residue, $C_1$–$C_4$hydroxyalkyl, $C_2H_4OC(=O)$—$R_1$, $C_2H_4NHC(=O)$—$R_1$ or $CH_2CH[OC(=O)$—$R_1][CH_2OC(=O)$—$R_1]$, provided that at least one group $R_{13}$, and preferably two groups $R_{13}$ are $C_{14}$–$C_{30}$alkyl, $C_2H_{40}C(=O)$—$C_{14}$–$C_{30}$alkyl, $CH_2CH[OC(=O)$—$C_{14}$–$C_{30}$alkyl][$CH_2OC(=O)$—$C_{14}$–$C_{30}$alkyl]. Preferably, the remaining groups $R_{13}$ are $C_1$–$C_4$alkyl, especially methyl or ethyl, or $C_1$–$C_4$hydroxyalkyl, especially hydroxymethyl or hydroxyethyl.

Specific examples of preferred compounds of formula (4) are:

distearyldimethylammoninm chloride dilauryldimethylammonium chloride dihexadecyldimethylammonium chloride distearyldimethylammonium bromide distearyldimethylammonium methosulfate and distearyldi-(isopropyl)-ammonium chloride distearoyl(hydroxyethyl)methylammonium methosulfate.

Preferred ester amide amine cationic fabric softening agents are those having the formula:

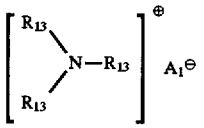

(5)

in which $R_{13}$ has its previous significance and $A_1$ is an inorganic or organic acid from which an union A is derived, wherein A has its previous significance, provided that at least one group $R_{13}$, and preferably two groups $R_{13}$ are $C_{14}$–$C_{30}$alkyl, $(CH_2)_nOC(=O)$—$C_{14}$–$C_{30}$alkyl, $(CH_2)_n$ $NHC(=O)$—$C_{14}$–$C_{30}$alkyl or $CH_2CH[OC(=)$—$C_{14}C_{30}$alkyl][$CH_2OC(=O)$—$C_{14}$–$C_{30}$alkyl], in which n has its previous significance. Preferably, the remaining groups $R_{13}$ are $C_1$–$C_4$alkyl, especially methyl or ethyl, or $C_1$–$C_4$hydroxyalkyl, especially hydroxymethyl or hydroxyethyl.

A preferred compound of formula (5) is:

3-stearoylamidopropyl-2-stearoyloxymethylmethylamine hydrochloride.

The cationic, amphoteric or anionic fluorescent whitening agent used may be one or more of the wide range of cationic, amphoteric or anionic fluorescent whitening agents, especially those which readily absorb UV light in the range λ=280–400 nm and convert the absorbed energy, by a chemical intermediate reaction, into non-interfering, stable compounds or into non-interfering forms of energy. The cationic, amphoteric or artionic fluorescent whitening agent should preferably be compatible with the rinse cycle fabric care agent and should be capable of absorption on to the washed textile material dating a rinse cycle fabric care treatment.

The cationic fluorescent whitening agent is preferably of the bistyrylphenyl class or phosphinic acid salt class; the amphoteric fluorescent whitening agent is preferably of the styrerie or amine oxide class; and the anionic fluorescent whitening agent is preferably of the aminostilbene, dibenzofuranylbiphenyl or bistyrylphenyl class.

One preferred class of cationic bistyrylphenyl fluorescent whitening agent is that having the formula:

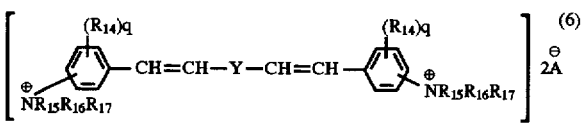

(6)

in which Y is arylene, preferably 1,4-phenylene or 4,4'-diphenylene, each optionally substituted by chloro, methyl or methoxy; q is 1 or 2; $R_{14}$ is hydrogen, chloro, $C_1$–$C_4$-alkyl, $C_1$–$C_4$-alkoxy, cyano or $C_1$–$C_4$-alkoxycarbonyl; $R_{15}$ and $R_{16}$ are $C_1$–$C_4$-alkyl, chloroethyl, methoxyethyl, β-ethoxyethyl, β-acetoxyethyl or β-cyanoethyl, benzyl or phenylethyl; $R_{17}$ is $C_1$–$C_4$-alkyl, $C_2$–$C_3$-hydroxyalkyl, β-hydroxy-γ-chloropropyl, β-cyanoethyl or $C_1$–$C_4$-alkoxycarbonylethyl; and A is an anion, preferably the chloride, bromide, iodide, methosulfate, ethosulfate, benzenesulfonate or p-toluenesulfonate anion when $R_{17}$ is $C_1$–$C_4$-allcyl or A is preferably the formate, acetate, propionate or benzoate anion when $R_{17}$ is β-hydroxy-γ-chloropropyl, β-cyanoethyl or $C_1$–$C_4$-alkoxy-carbonylethyl.

Preferred compounds of formula (6) are those in which Y is 1,4-phenylene or 4,4'-diphenylene; $R_{14}$ is hydrogen, methyl or cyano; $R_{15}$ is and $R_{16}$ are each methyl or cyano; and $R_{17}$ and A have their previously indicated preferred meanings.

One particularly preferred compound of formula (6) is that having the formula:

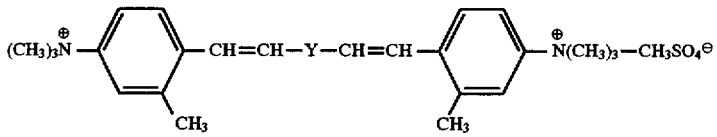

(7)

The compounds of formula (6) and their production are described in US-A-4 009 193.

A further preferred class of cationic bistyrylphenyl fluorescent whitening agent is that having the formula:

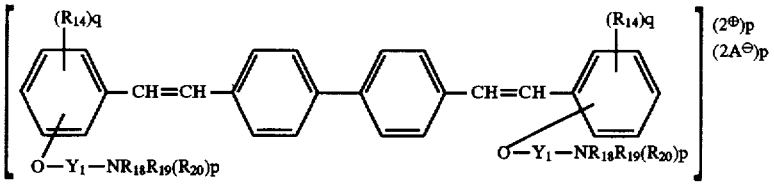

(8)

in which $R_{14}$ and q have their previous significance; $Y_1$ is $C_2$–$C_4$-alkylene or hydroxypropylene; $R_{18}$ is $C_1$–$C_4$-alkyl or, together with $R_{19}$ and the nitrogen to which they are each attached, $R_{18}$ forms a pyrrolidine, piperidine, hexamethyleneimine or morpholine ring; $R_{19}$ is $C_1$–$C_4$-alkyl or, together with $R_{18}$ and the nitrogen to which they are each attached, $R_{19}$ forms a pyrrolidine, piperidine, hexamethyleneimine or morpholine ring; $R_{20}$ is hydrogen, $C_1$–$C_4$-alkyl, $C_3$–$C_4$-alkenyl, $C_1$–$C_4$-akoxycarbonylmethyl, benzyl, $C_2$–$C_4$-hydroxyalkyl, $C_2$–$C_4$-cyanoalkyl or, together with $R_{18}$ and $R_{19}$ and the nitrogen atom to which they are each attached, $R_{20}$ forms a pyrrolidine, piperidine, hexamethyleneimine or morpholine ring; A has its previous significance; and p is 0 or 1.

Preferred compounds of formula (8) are those in which q is 1; $R_4$ is hydrogen, chlorine, $C_1$–$C_4$-alkyl or $C_1$–$C_4$-alkoxy; $Y_1$ is $(CH_2)2$; $R_{18}$ and $R_{19}$ are the same and each is methyl or ethyl; $R_{20}$ is methyl or ethyl; p is 1; and A is $CH_3OSO_3$ or $C_2H_5OSO_3$.

The compounds of formula (8) and their production are described in US-A-4 339 393.

A further preferred class of cationic bistyrylphenyl fluorescent whitening agent is that having the formula:

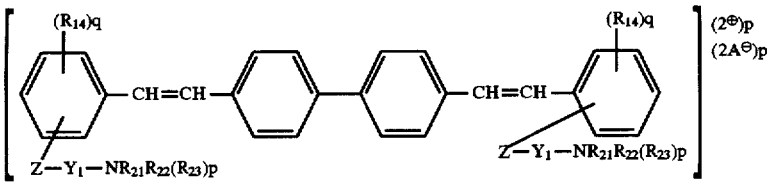

(9)

in which $R_{14}$, $Y_1$, A, p and q have their previous significance; $R_{21}$ and $R_{22}$, independently, are $C_1$–$C_4$-alkyl or $C_2$–$C_3$-alkenyl or $R_{21}$ and $R_{22}$, together with the nitrogen atom to which they are attached, form a pyrrolidine, piperidine, hexamethylenelmine or morpholine ring; $R_{23}$ is hydrogen, $C_1$–$C_4$-alkyl or $C_2$–$C_3$-alkenyl or $R_{21}$, $R_{22}$ and $R_{23}$, together with the nitrogen atom to which they are attached, form a pyridine or picoline ring; and Z is sulfur, —$SO_2$—, —$SO_2NH$—, —O—$C_1$–$C_4$alkylene—COO— or —OCO—.

Preferred compounds of formula (9) are those in which $R_{14}$ is hydrogen, chlorine, $C_1$–$C_4$-alkyl or $C_1$–$C_4$-alkoxy; $R_{21}$ and $R_{22}$, independently, are $C_1$–$C_4$-alkyl or, together with the nitrogen atom to which they are attached, form a pyrrolidine, piperidine or morpholine ring; $R_{23}$ is hydrogen, $C_1$–$C_4$-alkyl or $C_1$–$C_4$-alkenyl or $R_{21}$, $R_{22}$ and $R_{23}$, together with the nitrogen atom to which they are attached, form a pyridine ring; and Z is sulfur, —$SO_2$— or —$SO_2NH$—,.

The compounds of formula (9) and their production axe described in US-A-4 486 352.

A further preferred class of cationic bistyrylphenyl fluorescent whitening agent is that having the formula:

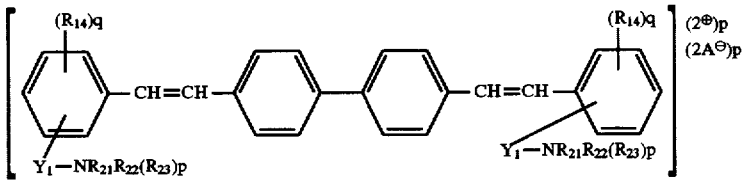

(10)

in which $R_4$, $R_{21}$, $R_{22}$, $R_{23}$, $Y_1$, A, p and q have their previous significance.

Preferred compounds of formula (10) are those in which q is 1; $R_{14}$ is hydrogen, chlorine, $C_1$–$C_4$-alkyl or $C_1$–$C_4$-alkoxy; $R_{21}$ and $R_{22}$, independently, axe $C_1$–$C_4$-alkyl or, together with the nitrogen atom to which they are attached, form a pyrrolidine, piperidine or morpholine ring; $R_{23}$ is hydrogen, $C_1$–$C_4$-alkyl or $C_3$–$C_4$-alkenyl or $R_{21}$, $R_{22}$ and $R_{23}$, together with the nitrogen atom to which they axe attached, form a pyridine ring.

The compounds of formula (10) and their production are described in US-A-4 602 087.

One preferred class of amphoteric styrene fluorescent whitening agent is that having the formula:

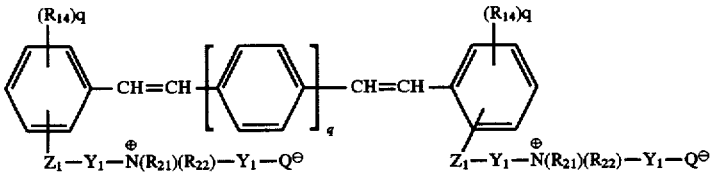

(11)

in which $R_{14}$, $R_{21}$, $R_{22}$, $Y_1$ and q have their previous significance and $Z_1$ is oxygen, sulfur, a direct bond, —COO—, —CON($R_{24}$)— or —$SO_2N(R_{24})$— in which $R_{24}$ is hydrogen, $C_1$–$C_4$-alkyl or cyanoethyl; and Q is —COO— or —$SO_3$.

Preferred compounds of formula (11) are those in which $Z_1$ is oxygen, a direct bond, —CONH—, —$SO_2NH$— or —COO—, especially oxygen; q is 1; $R_{21}$ is hydrogen, $C_1$–$C_4$-alkyl, methoxy or chlorine; and $R_{22}$, $R_{23}$, $Y_1$ and Q have their previous significance.

The compounds of formula (11) and their production are described in US-A-4 478 598.

One preferred class of amine oxide fluorescent whitening agent is that having the formula:

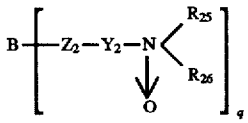

(12)

in which q has its previous significance; B is a brightener radical selected from a 4,4'-distyrylbiphenyl, 4,4'-divinylstilbene, and a 1,4'-distyrylbenzene, each optionally substituted by one to four substituents selected from halogen, $C_1$–$C_4$-alkyl, $C_1$–$C_4$-hydroxyalkyl, $C_1$–$C_4$-halogenoalkyl, $C_1$–$C_4$-cyanoalkyl, $C_1$–$C_4$-alkoxy–$C_1$–$C_4$-alkyl, phenyl-$C_1$–$C_4$-alkyl, carboxy-$C_1$–$C_4$-alkyl, carb-$C_1$–$C_4$-alkoxy-$C_1$–$C_4$-alkyl, $C_1$–$C_4$-alkenyl, $C_5$–$C_8$-cycloalkyl, $C_1$–$C_4$-alkoxy, $C_1$–$C_4$-alkenoxy, $C_1$–$C_4$-alkoxycarbonyl, carbamoyl, cyano, $C_1$–$C_4$-alkyl-sulfonyl, phenylsulfonyl, $C_1$–$C_4$-alkoxysulfonyl, sulfamoyl, hydroxyl, carboxyl, sulfo and trifluoromethyl; $Z_2$ is a direct bond between B and $Y_2$, an oxygen atom, a sulfur atom, —$SO_2$—, —$SO_2O$—, —COO—, —CON($R_{27}$)— or —$SO_2N(R_{27})$— in which $R_{27}$ is hydrogen or $C_1$–$C_4$-alkyl optionally substituted by halogen, cyano, hydroxyl, $C_2$–$C_5$-carbalkoxy, $C_1$–$C_4$-alkoxy, phenyl, chloromphenyl, methylphenyl, methoxyphenyl, carbamoyl or sulfamoyl; $Y_2$ is $C_2$–$C_4$-alkylene or $C_2$–$C_4$-alkyleneoxy–$C_2$–$C_4$-alkylene, each optionally substituted by halogen, hydroxyl, $C_2$–$C_5$-carbalkoxy, $C_1$–$C_4$-alkoxy, phenyl, chlorophenyl, methylphenyl, methoxyphenyl, carbamoyl or sulfamoyl; and $R_{25}$ and $R_{26}$, independently, are $C_5$–$C_8$-cycloalkyl, $C_1$–$C_4$-alkyl or phenyl, each optionally substituted by halogen, hydroxyl, $C_2$–$C_5$-carbalkoxy, $C_1$–$C_4$-alkoxy, phenyl, chlorophenyl, methylphenyl, methoxyphenyl, carbamoyl or sulfamoyl; in which, in all the carbamoyl or sulfamoyl groups, the nitrogen atom is optionally substituted by one or two $C_1$–$C_4$-alkyl, $C_1$–$C_4$-hydroxyalkyl, $C_2$–$C_5$-cyanoalkyl, $C_1$–$C_4$-halogenoalkyl, benzyl or phenyl groups.

Preferred brightener radicals B are those having the formula:

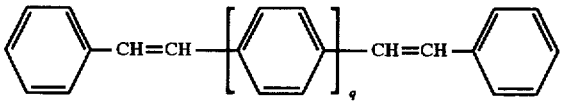

in which q has its previous significance and the rings are optionally substituted as indicated above.

Preferably $Z_2$ is oxygen, —$SO_2$— or —$SO_2N(R_{28})$— in which $R_{28}$ is hydrogen or $C_1$–$C_4$-alkyl optionally substituted by hydroxyl, halogen or cyano; and $R_{25}$ and $R_{26}$, independently, are $C_1$–$C_4$-alkyl optionally substituted by halogen, cyano, hydroxyl, $C_1$–$C_4$-alkoxy, phenyl, chlorophenyl, methylphenyl, methoxyphenyl or $C_2$–$C_5$-alkoxycarbonyl. Other preferred compounds of formula (10) are those in which $Z_2$ is oxygen, sulfur, —$SO_2$—, —CON($R_{28}$)— or —$SO_2N(R_{28})$— in which $R_{28}$ is hydrogen or $C_1$–$C_4$-alkyl optionally substituted by hydroxyl, halogen or cyano; and $Y_2$ is $C_1$–$C_4$-alkylene.

The compounds of formula (12) and their production are described in US-A-4 539 161.

One preferred class of cationic phosphinic acid salt fluorescent whitening agent is hhat having the formula:

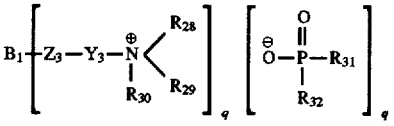

(13)

in which q has its previous significance; $B_1$ is brightener radical; $Z_3$ is a direct bond, —$SO_2$—$C_2$—$C_4$-alkyleneoxy, —$SO_2$—$C_2$—$C_4$-alkylene—COO—, —$SO_2$—, —COO—, —$SO_2$—$C_2$—$C_4$-alkylene—CON($R_{33}$)— or —$SO_2N$($R_{33}$)— in which $R_{33}$ is hydrogen or $C_1$–$C_4$-alkyl optionally substituted by hydroxyl, halogen or cyano; $R_{28}$ is $C_1$–$C_4$-alkyl or $C_2$–$C_4$-alkenyl, each optionally substituted by halogen, cyano, hyxdroxy, $C_1$–$C_4$-alkoxycarbonyl or $C_1$–$C_4$-alkylcarbonyloxy, or $R_{28}$ is benzyl, optionally substituted by halogen, $C_1$–$C_4$-alkyl or $C_1$–$C_4$-alkoxy, or $R_{28}$, together with $R_{29}$ or $Z_3$, forms a pyrrolidine, piperidine or morpholine radical; $R_{29}$ is $C_1$–$C_4$-alkyl or $C_2$–$C_4$-alkenyl, each optionally substituted by halogen, cyano, hydroxy, $C_1$–$C_4$-alkoxycarbonyl or $C_1$–$C_4$-alkylcarbonyloxy, or $R_{29}$ is benzyl, optionally substituted by halogen, $C_1$–$C_4$-alkyl or $C_1$–$C_4$-alkoxy, or $R_{29}$, together with $R_{28}$, forms a pyrrolidine, piperidine or morpholine radical; $R_{30}$ is $C_1$–$C_4$-alkyl; $R_{31}$ is hydrogen or $C_1$–$C_4$-alkyl, optionally substituted by cyano, hydroxy, $C_1$–$C_4$-alkoxycarbonyl or $C_1$–$C_4$-alkylcarbonyloxy; and $R_{32}$ is $C_1$–$C_4$-alkyl.

Preferably, brightener radical $B_1$ has the formula:

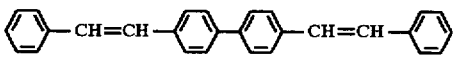

or the formula:

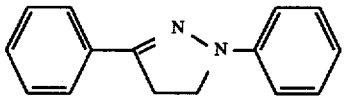

each optionally substituted by one to four substituents selected from halogen, $C_1$–$C_4$-alkyl, $C_1$–$C_4$-hydroxyalkyl, $C_1$–$C_4$-halogenoalkyl, $C_1$–$C_4$-cyanoalkyl, $C_1$–$C_4$-alkoxy–$C_1$–$C_4$-alkyl, phenyl–$C_1$–$C_4$-alkyl, carboxy–$C_1$–$C_4$-alkyl, carb-$C_1C_4$-alkoxy–$C_1$–$C_4$-alkyl, $C_1$–$C_4$-alkenyl, $C_5$–$C_8$-cycloalkyl, $C_1$–$C_4$-alkoxy, $C_1$–$C_4$-alkenoxy, $C_1$–$C_4$-alkoxycarbonyl, carbamoyl, cyano, $C_1$–$C_4$-alkyl-sulfonyl, phenylsulfonyl, $C_1$–$C_4$-alkoxysulfonyl, sulfamoyl, hydroxyl, carboxyl, sulfo and trifluoromethyl.

The compounds of formula (13) and their production are described in GB-A-2 023 605.

Preferred bis(triazinyl)diaminostilbene anionic fluorescent whitening agents for use in the present invention are those having the formula:

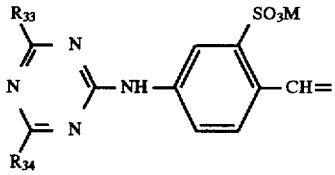

(14)

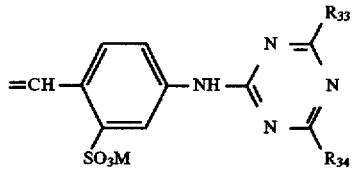

Preferred dibenzofuranylbiphenyl anionic fluorescent whitening agents for use in the present invention are those having the formula:

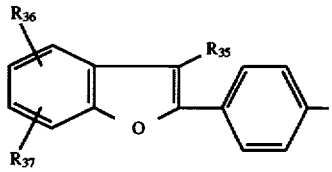

(15)

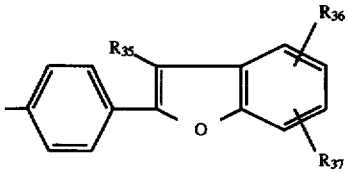

Preferred anionic bistyrylphenyl fluorescent whitening agents for use in the present invention are those having the formula:

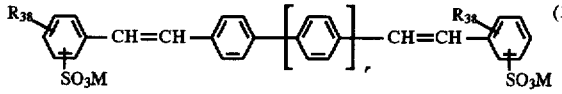

(16)

In the formulae (14) to (16), $R_{33}$ is phenyl optionally substituted by one or two $SO_3M$ groups and $R_{34}$ is NH—$C_1$–$C_4$-alkyl, N($C_1C_4$-alkyl)$_2$, NH—$C_1$–$C_4$-alkoxy, N($C_1$–$C_4$-alkoxy)$_2$, N($C_1$–$C_4$alkyl)($C_1$–$C_4$hydroxyalkyl), $N(C_1-C_4$-hydroxyalkyl$)_2$; $R_{35}$ is H, $C_1-C_4$-alkyl, CN, Cl or $SO_3M$; $R_{36}$ and $R_{37}$, independently, are H, $C_1-C_4$-alkyl, $SO_3M$, CN, Cl or O—$C_1-C_4$-alkyl, provided that at least two of $R_{35}$, $R_{36}$ and $R_{37}$ are $SO_3M$ and the third group has no solubilizing character, $R_{38}$ is H, $SO_3M$, O—$C_1-C_4$-alkyl, CN, Cl, COO—$C_1-C_4$-alkyl, or $CON(C_1-C_4$-alkyl$)_2$; M is is H, Na, K, Ca, Mg, ammonium, mono-, di-, tri- or tetra-$C_1-C_4$-alkylammonium, mono-, di- or tri-$C_1-C_4$-hydroxyalkylammonium or ammonium that is di- or hi-substituted with by a mixture of $C_1-C_4$-alkyl and $C_1-C_4$-hydroxyalkyl groups; and r is 0 or 1.

In the compounds of formulae (14) to (16), $C_1-C_4$-alkyl groups are, e.g., methyl, ethyl, n-propyl, isopropyl and n-butyl, especially methyl. Aryl groups are naphthyl or, especially, phenyl.

Specific examples of preferred compounds of formula (14) are those having the formulae:

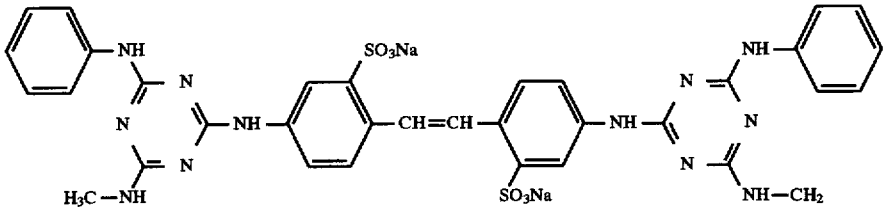

(17)

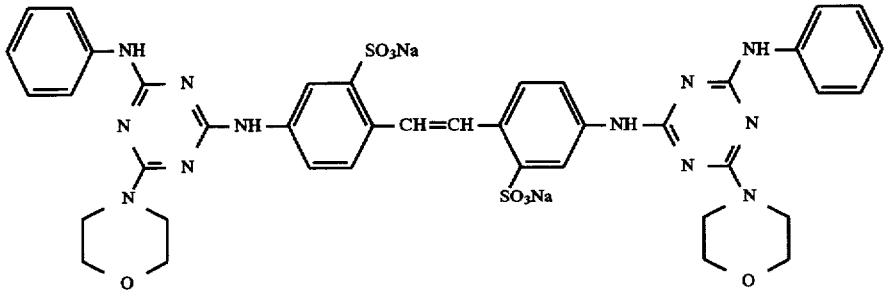

(18)

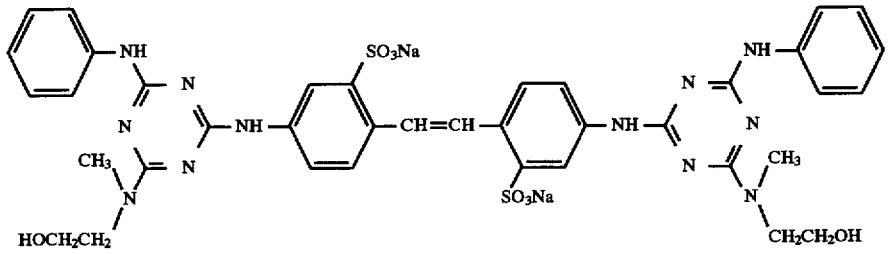

(19)

Preferred examples of compounds of formula (15) are those of formulae:

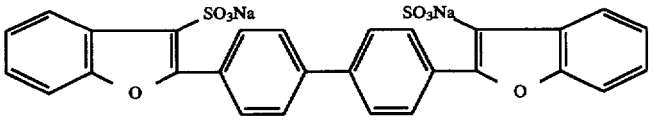

(20)

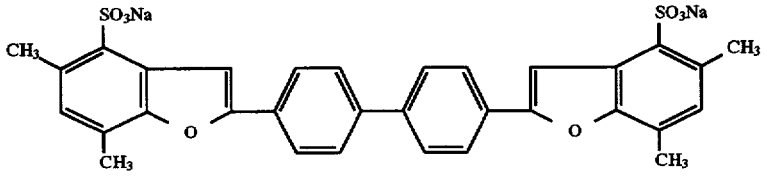

(21)

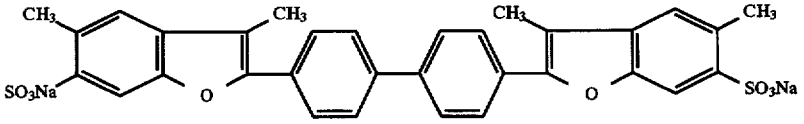

(22)

-continued

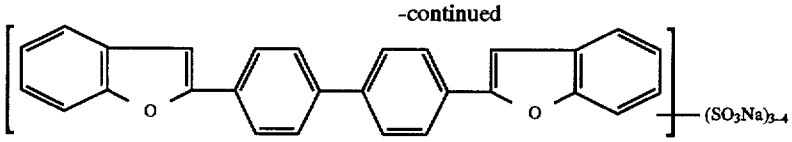

(23)

Preferred examples of compounds of formula (16) are those having the formulae:

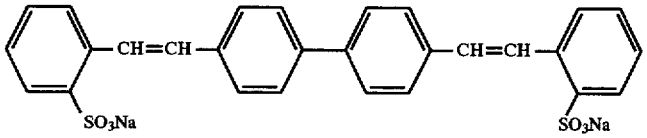

(24)

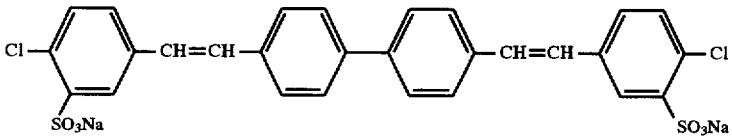

(25)

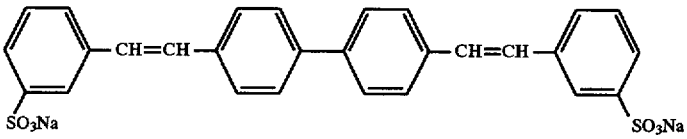

(26)

The compounds of formulae (14) to (16) are known and may be obtained by known methods.

In addition to the fluorescent whitening agent, the composition according to the present invention may also contain a minor proportion of one or more adjuvants. Examples of adjuvants include emulsifiers, perfumes, colouring dyes, opacifiers, UV absorbers, bactericides, nonionic surfactants, anti-gelling agents such as nitrims or nitrates of alkali metals, especially sodium nitrate, and corrosion inhibitors such as sodium silicate.

The amount of each of these optional adjuvants should not exceed 2% by weight of the composition.

The present invention also provides, as a third apect, a method for the treatment of a textile article, comprising applying, to a previously washed article, a fabric rinse composition comprising 0.3 to 10% by weight of a cationic, nmphoteric or arkionic fluorescent whitening agent, based on the total weight of the composition, and optionally a fabric care ingredient, the remainder being substantially water.

Preferably, the fabric cam ingredient is a fabric softener, a stain release or stain repellant ingredient or a waterproofing agent, which is preferably present in an amount of from 5 to 25%, especially from 10 to 20% by weight, based on the total weight of the composition.

A preferred method for the treatment of a textile article, comprises applying, to the previously washed article, a rinse cycle fabric softener composition comprising 5 to 25, preferably 10 to 20% by weight of a carlonit fabric softening agent and 0.3 to 10, preferably 0.3 to 3% by weight of a cationic, amphoteric or anionic fluorescent whitening agent, each based on the total weight of the composition, the remainder being substantially water.

The textile article treated according to the method of the present invention may be composed of any of a wide range of types of fibre such as wool, polyamide, cotton, polyester, polyacrylic, silk or any mixture thereof.

The method and composition of the present invention, in addition to providing an improved SPF to the washed textile article, and thereby enhanced protection to the skin, also increase the useful life of a textile article treated accorig to the present invention, e.g. by improving the tear strength and lightfastness of textile articles so treated.

The following Examples further illustrate the present invention.

EXAMPLE 1

The following rinse cycle softener base composition is made up:

7.0 g. distearyldimethylammordum chloride (72% active ingedient)

0.5 g. fatty alcohol ethoxylate 92.5 g. deionised water.

To this is added 0.3 g. of the amphoteric fluorescent whitening agent of formula:

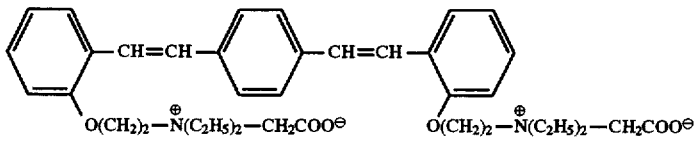

EXAMPLE 2

The following rinse cycle softener base composition is made up:

7.0 g. distearyldimethylammoninm chloride 0.5 g. fatty alcohol cthoxylate 92.5 g. deionised water.

To this is added 0.3 g. of the cationic fluorescent whitening agent of formula:

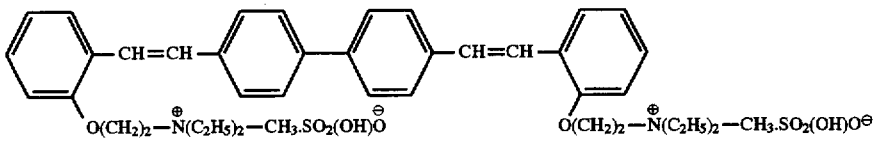

EXAMPLES 3 and 4

5 g. of cotton fabric are first washed with 4 g/l of ECE standard detergent using a liquor ratio of 1:20 at 60° C. The washed goods are then rinsed and are subjected, while still wet, to a rinse softener treatment. The mount of the rinse cycle softener base composition of Example 1 or 2 used is 5 g/l. The liquor ratio is 1:40 using tap water and the treatment is effected at 25° C. for 10 minutes. The softener-treated goods are then spin-dried at 60° C.

The whiteness and SPF values of the dried softener-treated goods are measured.

The dried softener-treated goods are then re-washed using the same detergent and washing conditions that are used for the initial wash except that, after the rinse, the re-washed goods are spin-dried at 60° C. without being subjected to a rinse softener treatment. The whiteness and SPF values of the re-washed, dried goods are measured.

The whiteness values of the respective dried goods are measured with a DCI/SF 500 spectrophotometer according to the Ganz method. The Ganz method is described in detail in the Ciba-Geigy Review, 1973/1, and also in the article "Whiteness Measurement", ISCC Conference on Fluorescence and the Colorimetry of Fluorescent Materials, Williamsburg, February 1972, published in the Journal of Color and Appearance, 1, No.5 (1972).

The Sun Protection Factor (SPF) is determined by measurement of the UV light transmitted through the swatch, using a double grating spectrophotometer fitted with an Ulbricht bowl. Calculation of SPF is conducted as described by B. L. Diffey and J. Robson in J. Soc. Cosm. Chem. 40 (1989), pp. 130–131.

The results are shown in the following Table.

TABLE

| | Rinse | Conc. | Without re-wash | | With re-wash | |
|---|---|---|---|---|---|---|
| Example | Composition | FWA | GW | SPF | GW | SPF |
| — | control (no FWA) | — | 67 | 3 | 75 | 3 |
| 3 | Rinse of Example 1 | 0.3 | 194 | 9 | 181 | 8 |
| | | 0.9 | 197 | 15 | 199 | 11 |
| | | 2.7 | 169 | 24 | 200 | 16 |
| 4 | Rinse of Example 2 | 0.3 | 199 | 14 | 182 | 13 |
| | | 0.9 | 206 | 17 | 202 | 20 |
| | | 2.7 | 193 | 29 | 193 | 26 |

The concentration of FWA denotes the concentration of active FWA compound based on the total weight of the rinse formulation.

The results in the Table clearly demonstrate the improvement in the Ganz Whiteness and SPF values of a cotton substrate treated with a rinse composition according to the present invention, both before and after a subsequent re-wash.

Similar results are obtained when the fluorescent whitening agent used in Example 1 or 2 is replaced by a compound having one of the following formulae:

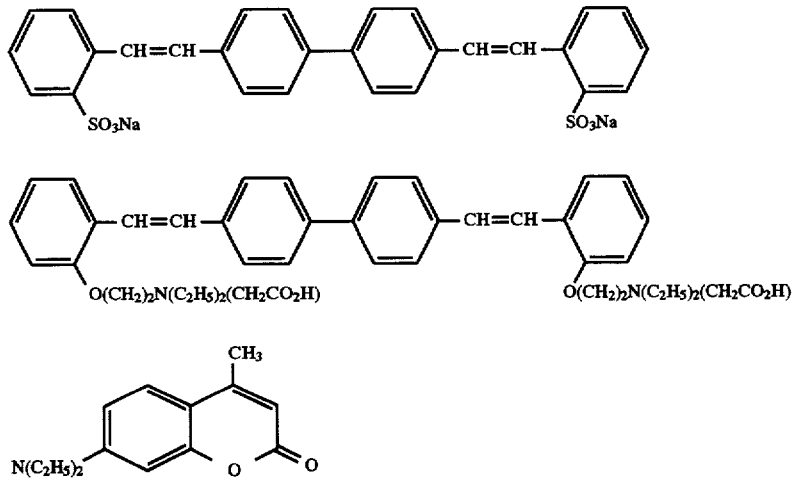

-continued

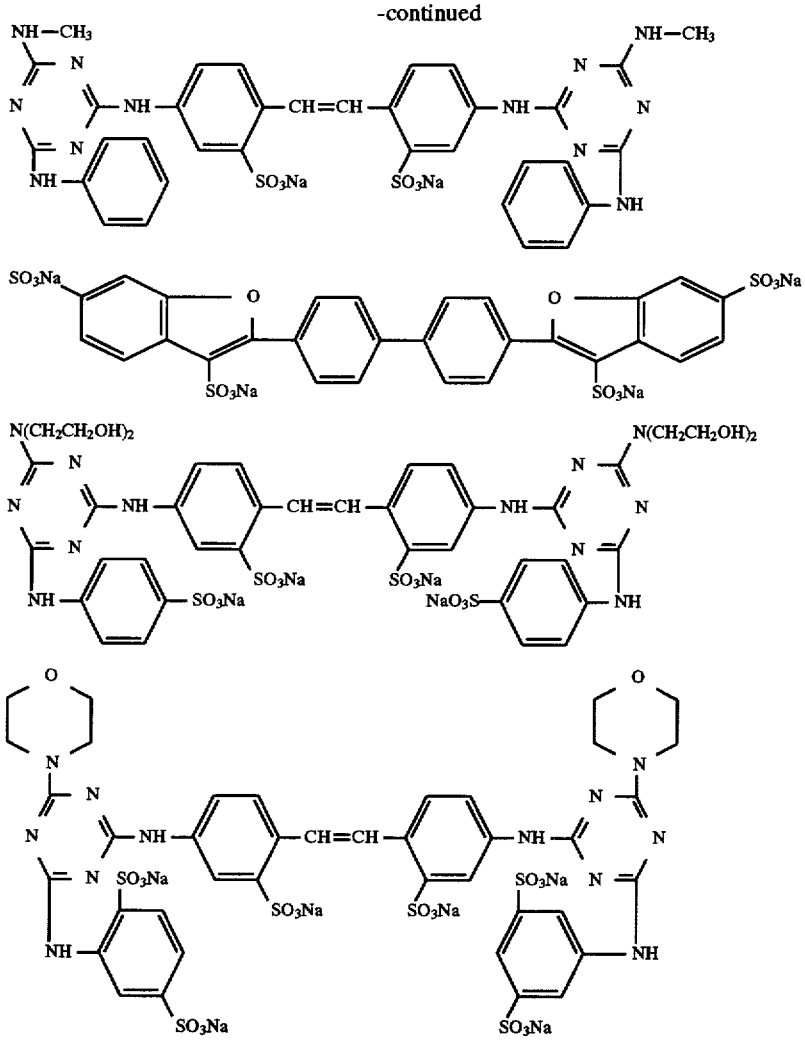

We claim:

1. A method for the treatment of a textile article, which comprises washing the textile article, then rinsing the washed textile article with an aqueous rinse cycle fabric softener composition comprising:

a) 5 to 25% by weight, based on the total weight of the composition, of a cationic fabric softening agent;

b) 0.3 to 10% by weight, based on the total weight of the composition, of a fluorescent whitening agent which is compatible with the cationic fabric softening agent and which is selected from the group consisting of:

1) the bistyryl compounds having the formula:

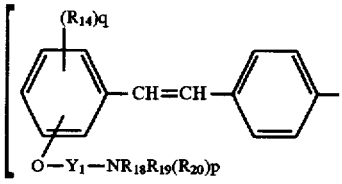

(8)

-continued

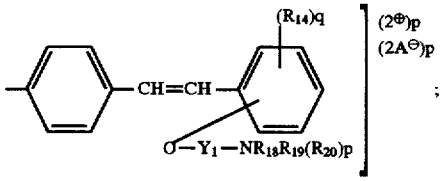

;

in which $R_{14}$ is hydrogen, chloro, $C_1$–$C_4$alkyl, $C_1$–$C_4$alkoxy, cyano or $C_1$–$C_4$alkoxycarbonyl; q is 1 or 2; $Y_1$ is $C_2$–$C_4$alkylene or hydroxypropylene; $R_{18}$ is is $C_1$–$C_4$alkyl or, together with $R_{19}$ and the nitrogen to which they are each attached, $R_{18}$ forms a pyrrolidine, piperdine, hexamethyleneimine or morpholine ring; $R_{19}$ is $C_1$–$C_4$alkyl or, together with $R_{18}$ and the nitrogen to which they are each attached, $R_{19}$ forms a pyrrolidine, piperidine, hexamethyleneimine or morpholine dng; $R_{20}$ is hydrogen, $C_1$–$C_4$alkyl, $C_3$–$C_4$alkenyl, $C_2$–$C_4$alkoxycarbonylmethyl, benzyl, $C_2$–$C_4$hydroxyalkyl, $C_2$–$C_4$cyanoalkyl or together with $R_{18}$ and $R_{19}$ and the nitrogen to which they are each attached, $R_{20}$ forms a pyrrolidine, piperidine, hexamethyleneimine or morpholine ring; $A^0$ is an anion; and p is 0 or 1;

2) the styrene compounds having the formula:

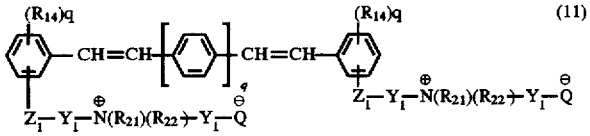

(11)

in which $R_{14}$ is hydrogen, chloro, $C_1$–$C_4$alkyl, $C_1$–$C_4$alkoxy, cyano or $C_1$–$C_4$alkoxycarbonyl; q is 1 or 2; $Y_1$ is $C_2$–$C_4$alkylene or hydroxypropylene; $R_{21}$ and $R_{22}$, independently, are $C_1$–$C_4$alkyl or $C_2$–$C_3$alkenyl or $R_{21}$ and $R_{22}$, together with the nitrogen atom to which they are each attached, form a pyrrolidine, piperidine, hexamethyleneimine or morpholine ring; $Z_1$ is oxygen, sulfur, a direct bond, —COO—, —CON($R_{24}$)—or —$SO_2$N($R_{24}$)— in which $R_{24}$ is hydrogen, $C_1$–$C_4$alkyl or cyanoethyl; and Q is —COO or —$SO_3$;

3) the bis(triazinyl)diaminostilbene compound of formula:

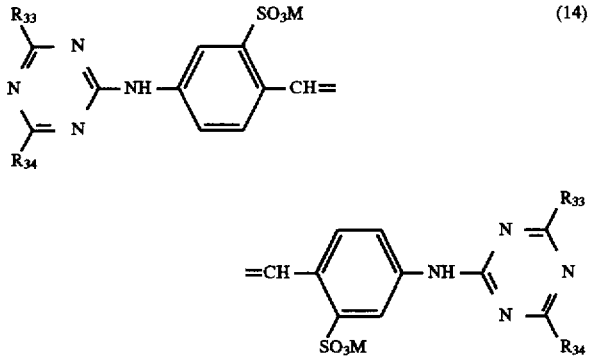

(14)

in which $R_{33}$ is NH-phenyl, optionally substituted by one or two $SO_3M$ groups, $R_{34}$ is NH—$C_1$–$C_4$alkyl, N($C_1$–$C_4$alkyl)$_2$, N($C_1$–$C_4$alkyl)($C_1$–$C_4$hydroxyalkyl), N($C_1$–$C_4$hydroxyalkyl)$_2$ or morpholino and M is H, Na, K, Ca, Mg, ammonium, mono-, di-, tri- or tetra–$C_1$–$C_4$alkylammonium, mono-, di- or tri- hydroxyalkylammonium or ammonium that is di- or tri-substituted with a mixture of $C_1$–$C_4$alkyl and $C_1$–$C_4$hydroxyalkyl groups;

4) the dibenzofuranylbiphenyl compounds having the formula:

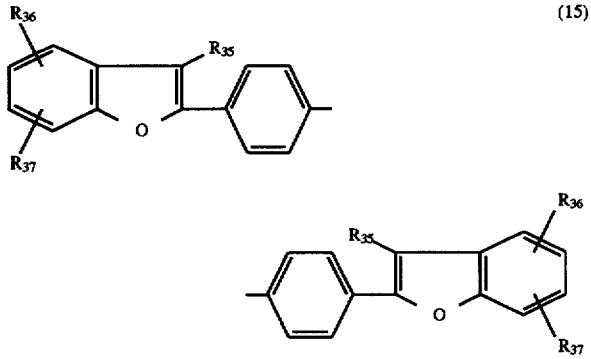

(15)

in which $R_{35}$ H, $C_1$–$C_4$alkyl, CN, Cl or $SO_3M$, $R_{36}$ and $R_{37}$, independently, are H, $C_1$–$C_4$alkyl, $SO_3M$, CN, Cl or O—$C_1$–$C_4$alkyl and M is H, Na, K, Ca, Mg, ammonium, mono-, di-, tri- or tetra–$C_1$–$C_4$alkyl ammonium, mono-, di- or tri-hydroxyalkylammonium or ammonium that is di- or tri-substituted with a mixture of $C_1$–$C_4$alkyl and $C_1$–$C_4$hydroxyalkyl groups, provided that at least two of $R_{35}$, $R_{36}$ and $R_{37}$ are $SO_3M$ and the third group has no solubilizing character; and 5) the bistyrylphenyl compounas having the formula:

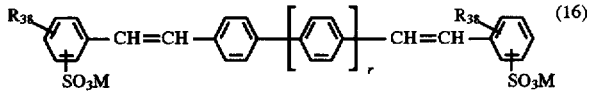

(16)

in which $R_{36}$ is H, $SO_3M$, O—$C_1$–$C_4$alkyl, CN, Cl, COO–$C_1$–$C_4$alkyl or CON($C_1$–$C_4$alkyl)$_2$, M is H, Na, K, Ca, Mg, ammonium, mono-, di-, tri- or tetra–$C_1$–$C_4$alkylammonium, mono-, di- or tri- hydroxyalkylammonium or ammonium that is di- or tri-substituted with a mixture of $C_1$–$C_4$alkyl and $C_1$–$C_4$hydroxyalkyl groups and r is 0 or 1; and c) the substantial remainder of the composition being water, whereby the sun protection factor of the textile fabric is increased by at least 300%.

2. A method according to claim 1 in which the cationic fabric softening agent is an imidazoline, a quaternary ammonium compound, an ester amide amine salt or a mixture thereof.

3. A method according to claim 2 in which the imidazoline cationic fabric softening agent has the formula:

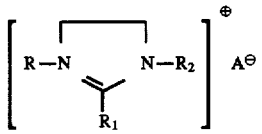

(1)

in which R is hydrogen or $C_1$–$C_4$alkyl; $R_1$ is a $C_8$–$C_{30}$aliphatic residue; $R_2$ is —$C_2H_4$—O(C=O)—$R_1$ or —$C_2H_4$—NH(C=O)—$R_1$; and $A^{\ominus}$is an anion.

4. A method according to claim 2 in which the imidazoline cationic fabric softening agent has the formula:

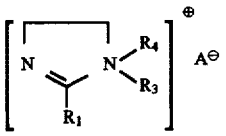

(2)

in which $R_1$ is a $C_8$–$C_{30}$aliphatic residue; $R_3$ and $R_4$, independently, are a $C_8$–$C_{30}$aliphatic residue, $C_1$–$C_4$alkyl, $C_1$–$C_4$halogenoalkyl, $C_1$–$C_4$hydroxyalkyl or a group —$C_2H_4$—N($R_5$)—C(=O)—$R_6$ in which $R_5$ is hydrogen or $C_8$–$C_{30}$alkyl and $R_6$ is hydrogen or $C_1$–$C_4$alkyl; and $A^{\ominus}$is an anion.

5. A method according to claim 2 in which the quaternary ammoninm compound has the formula:

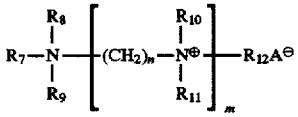

(3)

in which $R_7$ is a $C_8$–$C_{30}$aliphatic residue, $R_8$, $R_9$, $R_{10}$, $R_{11}$ and $R_{12}$, independently, are hydrogen, $C_1$–$C_4$alkyl or $C_1$–$C_4$hydroxyalkyl, $A^{\ominus}$ is an anion, m is an integer from 1 to 5 and n is an integer from 2 to 6.

6. A method according to claim 5 in which $R_7$ is $C_{12}$–$c_{18}$ alkyl and $R_8$, $R_9$, $R_{10}$, $R_{11}$ and $R_{12}$, independently, are $C_1$–$C_4$alkyl.

7. A method according to claim 2 in which the quaternary ammonium compound has the formula:

(4)

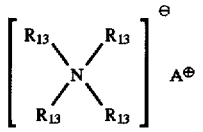

in which $A^{\ominus}$ is an anion and the groups $R_{13}$ may be the same or different and each is a $C_1$–$C_{30}$aliphafic residue, $C_1$–$C_4$hydroxyalkyl, $C_2H_4OC(=O)—R_1$, $C_2H_4NHC(=O)$-$R_1$ or $CH_2CH[OC(=O)—R_1][CH_2OC(=O)—R_1]$, provided that at least one group $R_{13}$ is $C_{14}$–$C_{30}$alkyl, $C_2H_4OC(=O)—C_{14}$–$C_{30}$alkyl, $C_2H_4NHC(=O)—C_{14}$–$C_{30}$alkyl or $CH_2CH[OC(=O)—C_{14}$–$C_{30}$alkyl$][CH_2OC(=O)—C_{14}$–$C_{30}$alkyl].

8. A method according to claim 7 in which two groups $R_{13}$ are $C_{14}$–$C_{30}$alkyl, $C_2H_4OC(=O)—C_{14}$–$C_{30}$alkyl, $C_2H_4NHC(=O)—C_{14}$–$C_{30}$alkyl or $CH_2CH[O\ C(=O)—C_{14}$–$C_{30}$alkyl$][CH_2OC(=O)—C_{14}$–$C_{30}$alkyl].

9. A method according to claim 8 in which two groups $R_{13}$ are $C_1$–$c_4$alkyl or $C_1$–$C_4$hydroxyalkyl.

10. A method according to claim 5 in which the imidazoline has the formula:

(5)

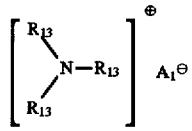

in which the groups $R_{13}$ may be the same or different and each is a $C_1$–$C_{30}$aliphatic residue, $C_1$–$C_4$hydroxyalkyl, $C_2H_4OC(=O)—R_1$, or $C_2H_4NHC(=O)—R_1$ or $CH_2CH(OC(=O)—R_1)(CH_2OC(=O)—R_1)$ provided that at least one group $R_{13}$ is $C_{14}$–$C_{30}$alkyl, $C_2H_4OC(=O)—C_{14}$–$C_{30}$alkyl, $C_2H_4NHC(=O)—C_{14}$–$C_{30}$alkyl or $CH_2CH(OC(=O)—C_{14}$–$C_{30}$alkyl$)(CH_2OC(=O)—C_{14}$–$C_{30}$alkyl) and $A_1^{\ominus}$ is the anion of an inorganic or organic acid.

11. A method according to claim 10 in which two groups $R_{13}$ are $C_{14}$–$C_{30}$alkyl, $C_2H_4OC(=O)—C_{14}$–$C_{30}$alkyl, $C_2H_4NHC(=O)—C_{14}$–$C_{30}$alkyl or $CH_2(OC(=O)—C_{14}$–$C_{30}$alkyl$)(CH_2OC(=O)—C_{14}$–$C_{30}$alkyl.

12. A method according to claim 11 in which the remaining groups $R_{13}$ are $C_1$–$C_4$alkyl or $C_1$–$C_4$hydroxyalkyl.

13. A method according to claim 3 in which $A^{\ominus}$ is a chloride, bromide, iodide, fluoride, sulfate, methosulfate, nitrite, nitrate or phosphate anion, or a carboxylate anion.

14. A method according to claim 13 in which the carboxylate anion is an acetate, adipate, phthalate, benzoate, stearate or oleate anion.

15. A method according to claim 3 in which the compound of formula (1) is 2-tallow-1-(2-stearoyloxyethyl)-imidazoline chloride, 2-tallow-1-(2-stearoyloxyethyl)-imidazoline sulfate, 2-tallow-1-(2-stearoyloxyethyl)-imidazoline methosulfate, 2-tallow-1-methyl-3-(2-stearoylamidoethyl)-imidazoline chloride, 2-tallow-1-methyl-3-(2-stearoylamidoethyl)-imidazoline sulfate or 2-tallow-1-methyl-3-(2-stearoylamidoethyl)-imidazoline methosulfate.

16. A method according to claim 4 in which the compound of formula (2) is:

2-heptadecyl-1-methyl-1-oleylamidoethyl-imidazolinium-method-sulfate, 2-heptadecyl-1-methyl-1-(2-stearoylamido)ethyl-imidazoliumium-sulfate, 2-heptadecyl-1-methyl-1-(2-stearoylamido)ethyl-imidazoliumium-chloride, 2-coco-1-(2-hydroxyethyl)-1-benzyl-imidazolinium-chloride 2-coco-1-(2-hydroxyethyl)-1-(4-chlorobutyl)-imidazolinium-chloride 2-coco-1-(2-hydroxyethyl)-1-octadecenyl-imidazolinium-chloride 2-coco-1-(2-hydroxyethyl)-1-benzyl-imidazolinium-chloride 2-coco-1-(2-hydroxyethyl)-1-(4-chlorobutyl)-imidazolinium-chloride 2-heptadecenyl-1-(2-hydroxyethyl)-1-(4-chlorobutyl)-imidazolinium-chloride 2-heptadecenyl-1-(2-hydroxyethyl)-1-benzyl-imidazolinium-chloride or 2-heptadecenyl-1-(2-hydroxyethyl)-1-octadecyl-imidazolinium-chloride.

17. A method according to claim 5 in which the compound of formula (3) is:

N-(tallow)-N,N',N',N'-tetramethyl-1,3-propanediammoniumdimethosulfate

N-(tallow)-N,N',N'-trimethyl-1,3-propanediammoniumdimethosulfate

N-(tallow)-N,N,N',N',N'-pentamethyl-1,3-propanediammoniumdimethosulfate

N-oleyl-N,N,N',N',N'-pentamethyl-1,3-propanediammoniumdime thosulfate

N-stearyl-N,N,N',N',N'-pentamethyl-1,3-propanediammoniumdime thosulfate or

N-stearyloxypropyl-N,N',N'-tris(3-hydroxypropyl)-1,3-propanediammoniumdiacetate.

18. A method according to claim 7 in which the compound of formula (4) is:

distearyldimethylammonium chloride dilauryldimethylammonium chloride dihexadecyldimethylammonium chloride distearyldimethylammonium bromide distearyldimethylammonium methosulfate distearyldi(isopropyl)ammonium chloride or distearoyl(hydroxyethyl)methylammonium chloride.

19. A method according to claim 10 in which the compound of formula (5) is: 3-stearoylamidipropyl-2-stearoyloxymethyl-methylamine hydrochloride.

20. A method according to claim 1 in which $Y_1$ is $(CH_2)_2$; $R_{18}$ and $R_{19}$ are the same and each is methyl or ethyl; $R_{20}$ is methyl or ethyl; p is 1; and A is $CH_3OSO_3$ or $C_2H_5OSO_3$.

21. A method according to claim 1 in which $Z_1$ is oxygen, a direct bond, —CONH—, —$SO_2$NH— or —COO—; q is 1; and $R_{14}$ is hydrogen, $C_1$–$C_4$-alkyl, methoxy or chlorine.

22. A method according to claim 21 in which $Z_1$ is oxygen.

23. A method according to claim 11 wherein the fabric softener composition also contains 0.5 to 2% by weight of an adjuvant selected from an emulsifier, perfume, colouring dye, opacifier, a UV absorber, bactericide, nonionic suffactant, anti-gelling agent and corrosion inhibitor.

24. A composition according to claim 23 in which the anti-gelling agent is a nitrite or nitrate of an alkali metal and the corrosion inhibitor is sodium silicate.

25. A method according to claim 1 in which the rinse cycle fabric softener composition comprises 10 to 20% by weight of a cationic fabric softening agent and 0.3 to 3% by weight of a fluorescent whitening agent each based on the total weight of the composition, the remainder being substantially water.

26. A method according to claim 1 which the textile article treated is composed of wool, polyamide, cotton, polyester polyacrylic silk or any mixture thereof.

27. A method according to claim 1 whereby the treated textile article has improved tear strength and/or lightfastness .

* * * * *